United States Patent [19]

Schilger

[11] Patent Number: 4,602,467

[45] Date of Patent: Jul. 29, 1986

[54] THIN SHELL CONCRETE WALL PANEL

[76] Inventor: Herbert K. Schilger, 32 Castleglen Court N.E., Calgary, Alberta T3J 2B8, Canada

[21] Appl. No.: 626,980

[22] Filed: Jul. 2, 1984

[51] Int. Cl.[4] ..... E04B 5/18

[52] U.S. Cl. ..... 52/319; 52/414; 52/601

[58] Field of Search ..... 52/319, 414, 600, 601

[56] References Cited

U.S. PATENT DOCUMENTS

| | | | |
|---|---|---|---|
| 1,346,016 | 7/1920 | Gomsrud . | |
| 2,039,183 | 4/1936 | Nagel . | |
| 2,071,349 | 2/1937 | Lane . | |
| 2,270,672 | 1/1942 | Heeren . | |
| 2,704,935 | 3/1955 | Uddenborg | 52/601 X |
| 3,442,056 | 5/1969 | Van der Lely et al. | 52/601 X |
| 3,956,864 | 5/1976 | Fung | 52/414 |
| 4,112,646 | 9/1978 | Clelland | 52/372 |
| 4,185,437 | 1/1980 | Robinson | 52/601 |

*Primary Examiner*—J. Karl Bell

[57] ABSTRACT

A building panel is described which can be used for either walls or floors. It comprises a thin shell unit of reinforced, monolithic cementitious material having a large, planar outer face and an inner face interconnected by parallel end edges and parallel side edges. A plurality of stud members are partially embedded in the inner face of the cementitious shell, these stud members being parallel to each other, laterally spaced from each other and being fabricated of about 15 to 25 gauge galvanized steel sheet. This steel sheet material is shaped to provide a web portion with one longitudinal edge of the web being shaped to lock the stud within the concrete shell and the longitudinal edge of the web remote from the concrete shell comprising an L-shaped flange defining the outer surface of the stud member to which a finished panel may be attached. Channel-shaped metal beam members connect the ends of the studs.

8 Claims, 18 Drawing Figures

THIN SHELL CONCRETE WALL PANEL

This invention relates to building constructions and, more particularly, to pre-cast cementitious panels with metal studs.

Many different types of pre-cast panels have been provided in the past to form walls of building structures. Some of these pre-cast panels have included insulation and others have included structures cast in the panels for attaching both interior and exterior finishing panels thereto.

Many examples of previously known pre-cast and otherwise constructed cementitious wall panels are disclosed in U.S. Pat. Nos. 723,175, 984,517, 1,445,113, 1,617,033, 2,303,837, 3,466,825, 3,605,366, 3,605,607 and 4,112,626.

It is the object of the present invention to provide a very simple and inexpensive cementitious wall or floor construction panel, which will be strong yet light in weight with steel studs embedded in one face of the panel.

The present invention in its broadest aspect relates to a panel for use as a building construction unit and comprising a thin shell unit of reinforced, monolithic cementitious material having a large, planar outer face and an inner face interconnected by parallel end edges and parallel side edges. A plurality of stud members are partially embedded in the inner face of the cementitious shell, these stud members being parallel to each other, laterally spaced from each other and being fabricated of about 15 to 25 gauge galvanized steel sheet. This steel sheet material is shaped to provide a web portion with one longitudinal edge of the web being shaped to lock the stud within the concrete shell and the longitudinal edge of the web remote from the concrete shell comprising an L-shaped flange defining the outer surface of the stud member to which a finished panel may be attached. Channel-shaped metal beam members connect the ends of the studs.

The panels in accordance with this invention generally have a cementitious shell thickness of about 1½ to 2 inches with a reinforcing mesh embedded therein. As a consequence, they are quite light in weight, typically having a weight of about 20 pounds per square foot. Excellent strength is provided with quite shallow embedding of the studs and these are typically embedded into the cementitious shell to a depth of about ⅜ inch to ½ inch. Preferably, the embedded edges of the studs are mechanically connected to the reinforcing mesh.

The panels can be manufactured in many different sizes and a typical panel will have a height of 8 to 12 feet and lengths varying from about 6 to 30 feet.

According to one preferred embodiment of the invention, the embedded edge of each stud includes a plurality of slits and expanded loops, these loops providing locking means between the stud and the cementitious material and the loops also providing means for connecting the stud to reinforcing mesh embedded in the cementitious material. The connection between the studs and the reinforcing mesh can easily be made by means of wire ties or metal clips.

In accordance with another preferred embodiment, the embedded edge of each stud includes a narrow flange generally perpendicular to the stud web. The narrow flange has dimples or undulations to provide a locking within the cementitious material and the reinforcing mesh may be attached to each flange by means of sheet metal screws.

According to yet another embodiment, the interlock between the stud and the cementitious material may be achieved by means of clip members which mechanically hold the reinforcing mesh adjacent a stud edge flange while also being embedded in the cementitious material. These clip members may have a variety of different shapes and may be held to the stud flanges by means of metal screws.

The construction panels of this invention have a number of advantages. For instance, there is no shadowing in the surface of the finished panels adjacent the embedded studs or locking clips. Furthermore, cracking of the panels adjacent the embedded studs is significantly reduced. Also, since no welding is involved in the assembling of the metal components, all of the metal components may be galvanized.

Certain preferred embodiments of the invention are illustrated by the accompanying drawings wherein.

Figure 1:
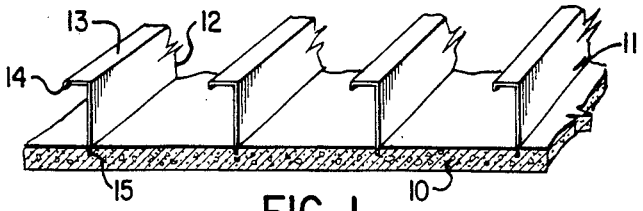
FIG. 1 is a perspective view of studs embedded in a concrete shell.

Referring now more specifically to FIG. 1 of the drawings, the numeral 10 generally designates a thin shell wall of concrete, while the numeral 11 designates metal studs partially embedded in the concrete shell. Each stud is shaped from 20 gauge galvanized steel and includes a web portion 12 with an outer flange 13 and a lip 14 together forming an outer L-shaped flange portion. This outer flange provides a surface to which finished panels may be attached.

Figure 2:
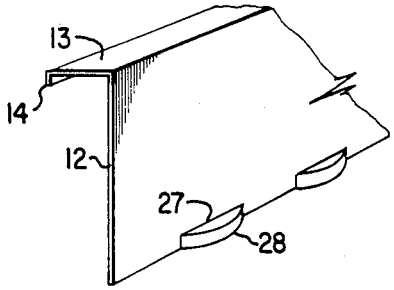
FIG. 2 is a perspective view of a preferred form of locking mechanism.

The other longitudinal edge 15 of web 12 is shaped or deformed so that the stud may be locked within the concrete shell. This deformation or shaping of the edge is shown in greater detail in FIGS. 2 and 3. As will be seen from FIG. 2, slits 27 are cut adjacent the edge and the portion adjacent each slit is then pressed to form an expanded loop 28. These loops 28 have the dual function of firstly locking the edge of stud 11 within the concrete shell 10 and secondly providing a convenient means for attaching a reinforcing mesh 23 to the studs 11. The actual connection between the reinforcing mesh and the loops 28 can be made by means of wire loops or metal clips.

Figure 3:
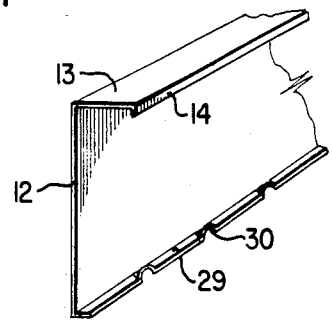
FIG. 3 is a perspective view of an alternative embodiment of a locking mechanism.

Another form of edge locking is shown in FIG. 3 in which a shallow flange 29 is formed with dimpled portions 30 providing the locking with the concrete shell 10.

Figure 4:
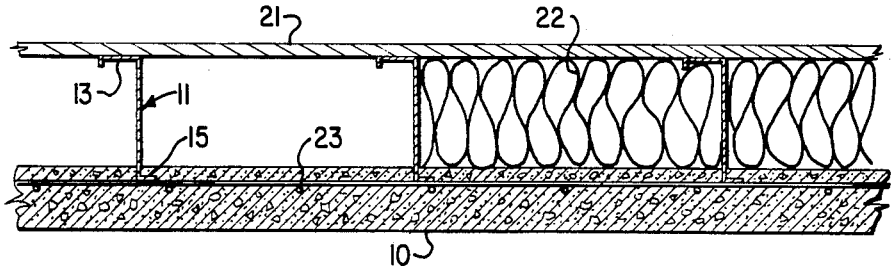
FIG. 4 is a sectional view of a wall panel in accordance with the invention including an inner panel.

Looking now at FIG. 4, greater details are shown, including the relative distance that the reinforcing mesh 23 is embedded in the concrete shell 10 and how the reinforcing mesh 23 may connect to the studs 11. Interior finishing panels 21 are attached to outer flanges 13 of studs 11 with insulation 22 filling the gap between the interior finishing panels 21 and the outer concrete shell 10.

Figure 5:
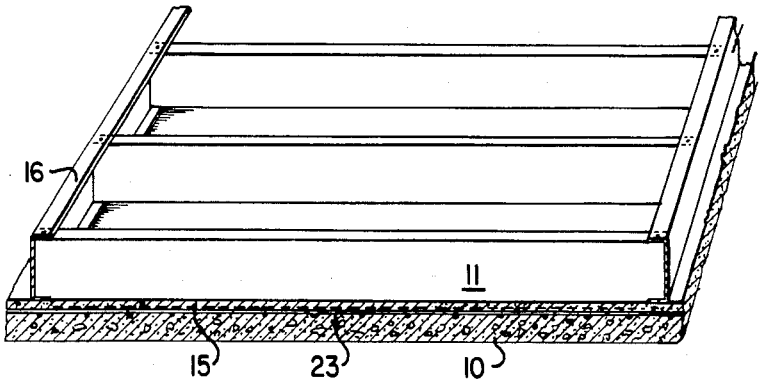
FIG. 5 is a perspective view showing details of a completed panel.

A typical completed panel is illustrated in FIG. 5 and it will be seen that the studs are generally equally spaced and are connected at top and bottom by means of galvanized steel channel members 16. Openings for windows, etc. can be preformed or may be cut into the shell after it is formed.

Figure 6:
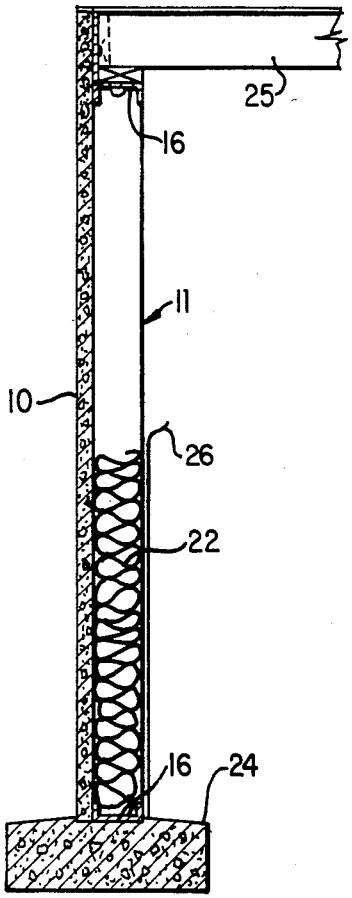
FIG. 6 is a sectional view showing an assembly in accordance with the invention.
Figure 7:
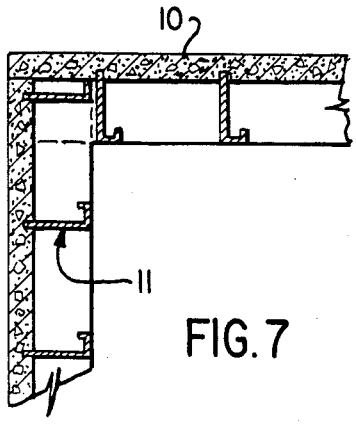
FIG. 7 is a sectional view showing an outside corner in accordance with the invention.
Figure 8:
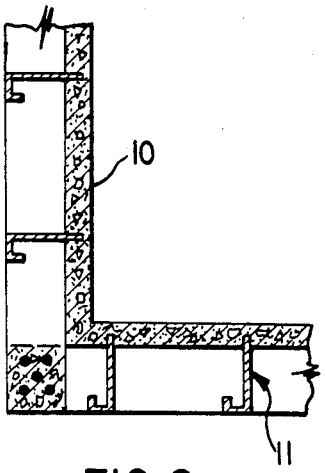
FIG. 8 is a sectional view showing an inside corner in accordance with the invention.

A typical assembly is shown in FIG. 6 with the panels of the invention forming the complete wall of a building. The panels rest on a concrete foundation 24 and the panels support cross-beams 25. A plastic film liner 26 may be provided between the studs 11 and the innerfinishing panels 21. A typical example of an outside corner according to the invention is shown in FIG. 7 while FIG. 8 shows a typical inside corner.

Figure 9:
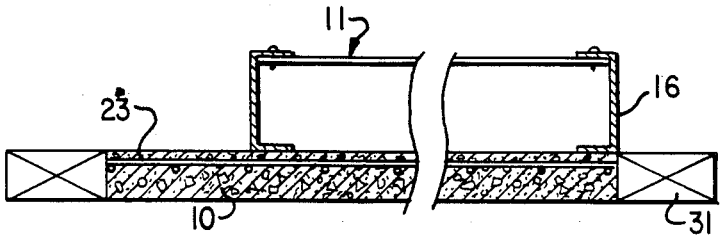
FIG. 9 shows a method of producing a panel according to the invention.

A simplified view of how the panels of the invention may be fabricated is shown in FIG. 9. Bulkheads 31 are provided within which a cementitious composition is poured. The wet composition is leveled within the bulkheads.

Figure 10:
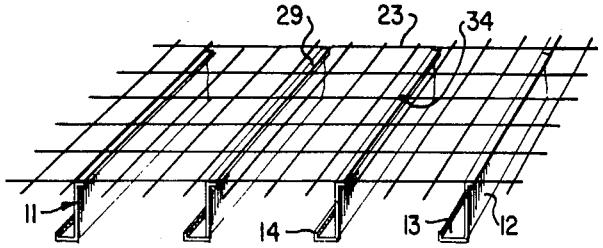
FIG. 10 is a perspective view showing the studs with reinforcing mesh attached thereto.
Figure 11:
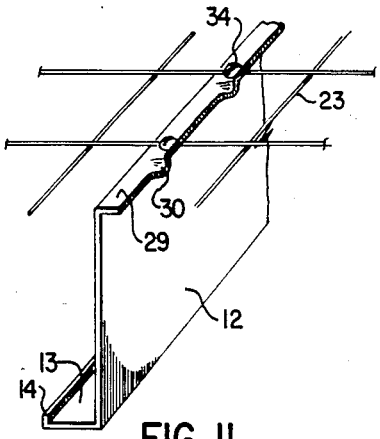
FIG. 11 is a perspective view showing a method of attaching reinforcing mesh to studs according to the invention.

The reinforcing mesh may be positioned within the bulkhead either before or after the cementitious composition has been poured. In a preferred arrangement, the stud framework is assembled and attached to reinforcing mesh, e.g. as shown in FIGS. 10 and 11. As shown, the reinforcing mesh 23 is attached to the flanges 29 of studs 11 by means of self-tapping metal screws 34. This can be seen in greater detail in FIG. 11 where it will be seen that the screws 34 have relatively large heads which press and hold the mesh against the flanges 29.

This assembly is then placed on the top surface of the wet cementitious composition within the bulkheads 31 and the assembly is then vibrated, causing it to sink into the wet cementitious composition until the edge flanges of the channel members 16 rest on the surface of the wet cementitious composition. The cementitious composition is then allowed to cure, forming a concrete shell with the studs 11 and reinforcing mesh 23 embedded therein. After curing, the panels can easily be lifted and moved for installation in building structures.

Figure 12:
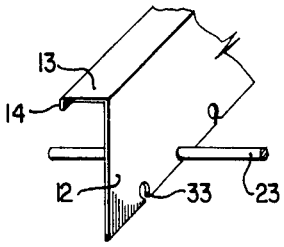
FIG. 12 is a perspective view showing an alternative means for connecting reinforcing mesh to a stud.

There are many possible methods of connecting the studs 11 to the reinforcing mesh 23. An example of one of these is shown in FIG. 12 where slots 33 are provided in the lower edge of web 12 into which the reinforcing mesh 23 may be snapped and held, thereby providing the desired connection between the stud and the reinforcing mesh.

Figure 13:
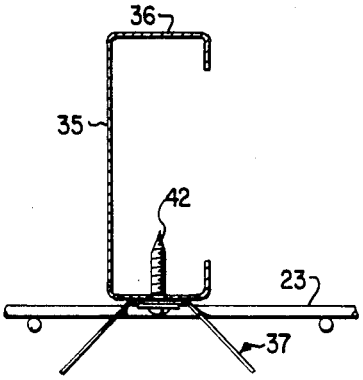
FIG. 13 is a partial sectional view of a fastening clip and channel shaped stud.
Figure 14:
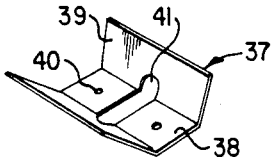
FIG. 14 is a perspective view of the fastening clip of FIG. 13.

FIGS. 13 and 14 show another embodiment in which the studs are in the form of C-channel members, each having a central web portion 35 and edge flanges 36. With this arrangement, the connection between the stud and the concrete panel is achieved by means of clip members 37 which are embedded in the concrete. As will be seen from FIG. 14, each of these clips includes a central flat portion 38 with a pair of outwardly inclined flanges 39 extending therefrom. The central portion 38 has holes 40 therein to receive self-tapping screws and a slot 41 is provided for holding the reinforcing mesh.

The clip 37 is installed as shown in FIG. 13 with the self-tapping screws 42 passing through the holes 40 and into flange 36. This holds the reinforcing mesh 23 in position adjacent the flange 36 and the outwardly inclined flanges 39 of the clips 37 provide an interlock within the cured cement composition.

Figure 15:
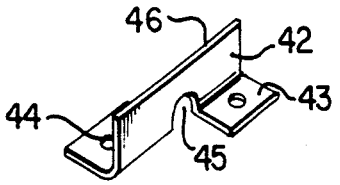
FIG. 15 is a perspective view of an alternative form of fastening clip.
Figure 16:
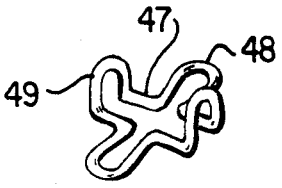
FIG. 16 is a perspective view of a further alternative form of fastening clip.

These anchoring clips can assume many different shapes while serving the function of holding the reinforcing mesh in position and anchoring the stud to the concrete. Examples of different shapes of these clips are shown in FIGS. 15 and 16. The clip of FIG. 15 has a central portion 42 with a pair of flanges 43 and 44 perpendicular thereto. Between the flanges 43 and 44 is a recess 45 within which the reinforcing mesh rests. Holes 44 are provided in the flanges 43 for inserting self-tapping screws to anchor the clip to an edge flange of a stud. Upper edge of central portion 42 has undulations 46 for anchoring to the concrete.

The arrangement of FIG. 16 comprises a rod portion 47 shaped with a pair of opposite flat loops 48 and a pair of upwardly turned loops 49. The flat loops 48 rest against flange 36 of a stud and are held in position by self-tapping screws which pass through the inner portions of loops 48. The upwardly turned portions 49 serve as recesses for holding the reinforcing mesh adjacent the stud.

Figure 17:
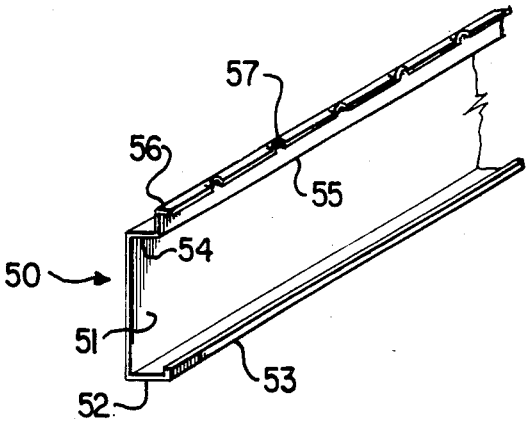
FIG. 17 is a perspective view of a further alternative form of stud according to the invention.

Another preferred embodiment of this invention is illustrated by FIG. 17. This shows a beam or stud member 50 formed of galvanized steel and which is formed from a standard C-channel section. Thus, each stud or beam 50 includes a central web portion 51 with a pair of edge flanges. One of the flanges remains in the standard configuration including a flange portion 52 which is perpendicular to web 51. The outer edge of flange 52 terminates in a shallow lip 53 which is perpendicular to flange 52.

The other edge includes a flange portion 54 which is bent outwardly to form a second flange portion 55 perpendicular to flange portion 54. The outer edge of flange portion 55 terminates in a shallow lip 56 and this lip portion 56 has a series of dimples 57 to provide a mechanical locking with a concrete panel.

Figure 18:
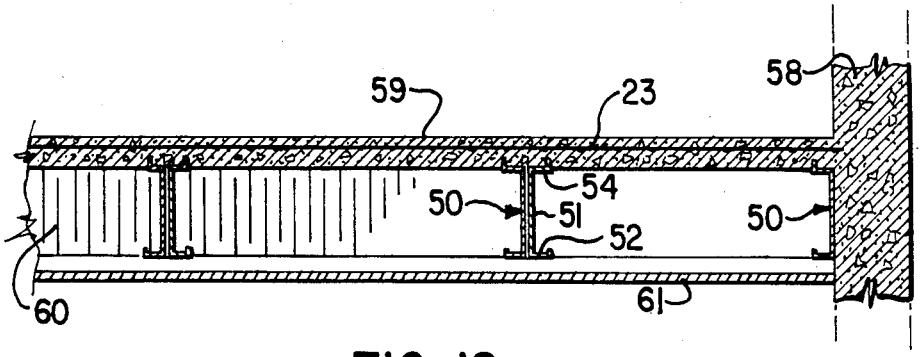
FIG. 18 is a sectional view of the stud of FIG. 17 being used in a floor construction.

The use of stud or beam 50 in a construction assembly is illustrated in FIG. 18. Here it is being used as part of a floor structure, although it can be used in the same manner as part of a wall panel. For constructing a floor assembly, pairs of the beams 50 are mounted back to back as shown and the flange portions 55 and the lip portions 56 are embedded in the concrete forming the floor structure. This can be done either in a prefabrication plant or the floor may be formed in situ. FIG. 18 illustrates an in situ installation with the beams 50 being assembled, positioned and supported from beneath. Foam plastic insulation 60 is mounted between the beams 50 and this serves not only as insulation but also as a support for the pouring of a concrete floor. Thus, with the beams 50 and insulation 60 assembled adjacent a support wall 58, a cementitious composition is poured on top of the insulation and surrounding the reinforcing mesh and the flange portions 55 and 56 of the beams 50. This is then allowed to cure to form the floor structure. If desired, a ceiling panel 61 can be mounted from below by means of self-tapping screws which extend into the flange 52 of the beams 50.

If the beams or studs 50 are to be used in a prefabrication mode, then a cementitious composition is poured into a mold, the reinforcing mesh is appropriately positioned within the cementitious composition and a frame assembly including the beams or studs 50 is lowered into the upper surface of the cementitious composition and the entire assembly is then allowed to cure. The result is a prefabricated reinforced panel structure which can be utilized either as a floor or wall component.

The foregoing is considered as illustrative only of the principles of the invention. Since numerous modifications and changes will readily occur to those skilled in the art, it is not desired to limit the invention to the exact construction and operation shown and described, and accordingly all suitable modifications and equivalents may be resorted to as may fall within the scope of the invention.

I claim:

1. A panel for use as a building component comprising a thin shell member of reinforced, monolithic cementitious material having a large, planar outer face and an inner face interconnected by end edges and side edges, a plurality of stud members partially embedded in the inner face of the cementitious shell, said stud members being parallel to each other and each said stud member being fabricated of galvanized steel sheet bent to form a channel member having a central web portion and first and second flanges substantially perpendicular to said web portion, the free edge of said first flange merging into an outwardly extending locking projection, said locking projection including a continuous strip projecting outwardly substantially perpendicular to said first flange and a lip portion extending from the outer edge of said continuous strip and substantially perpendicular thereto, said locking projection being embedded in the cementitious shell with said first flange resting against the inner face of the cementitious shell, and beam members connecting the ends of said studs.

2. A panel according to claim 1 wherein the cementitious shell has a thickness of up to 2 inches.

3. A panel according to claim 2 wherein the locking projections are embedded in the cementitious shell to a depth of $\frac{3}{8}$ inch to $\frac{1}{2}$ inch.

4. A panel according to claim 3 wherein the studs are arranged back-to-back in pairs to form support beams of a floor structure.

5. A method of producing a panel for use as a building component, which comprises (a) preparing a framework comprising a plurality of stud members, said stud members being parallel to each other and laterally spaced from each other, each said stud member being fabricated of galvanized steel sheet bent to form a channel member having a central web portion and first and second flanges substantially perpendicular to said web portion, the free edge of said first flange merging into an outwardly extending locking projection, said locking projection including a continuous strip projecting outwardly substantially perpendicular to said first flange and a lip portion extending from the outer edge of said continuous strip and substantially perpendicular thereto, and channel-shaped galvanized steel beam members connecting the ends of said studs, (b) pouring a wet cementitious material into a mold having a bottom, end edges and side edges, (c) positioning reinforcing mesh and the locking projections of studs in the wet cementitious material with the first flanges and the edges of the end beams of the framework resting on the surface of the wet cementitious material and (d) allowing the wet cementitious material to cure into a hard concrete shell.

6. A method according to claim 5 wherein the reinforcing mesh is attached to the studs, the assembled reinforcing mesh and stud framework are laid on top of the wet cementitious material in the mold and then vibrated to sink the reinforcing mesh and the locking edges of the studs into the wet cementitious material until the edges of the end beams of the framework rest on the surface of the wet cementitious material.

7. A method according to claim 6 wherein the cementitious shell is formed with a thickness of up to 2 inches.

8. A method according to claim 7 wherein the edges of the studs are embedded in the cementitious material to a depth of $\frac{3}{8}$ inch to $\frac{1}{2}$ inch.

* * * * *